US006591061B2

(12) United States Patent
Wang

(10) Patent No.: US 6,591,061 B2
(45) Date of Patent: Jul. 8, 2003

(54) HUMIDIFIER

(75) Inventor: Chi-Hsiang Wang, Taipei (TW)

(73) Assignee: Burton, Inc., Hoffman Estates, IL (US)

( * ) Notice: Subject to any disclaimer, the term of this patent is extended or adjusted under 35 U.S.C. 154(b) by 0 days.

(21) Appl. No.: 09/849,670

(22) Filed: May 7, 2001

(65) Prior Publication Data

US 2002/0039487 A1 Apr. 4, 2002

Related U.S. Application Data

(60) Provisional application No. 60/237,928, filed on Oct. 3, 2000.

(51) Int. Cl.[7] ..... F24F 6/08
(52) U.S. Cl. ..... 392/395
(58) Field of Search ..... 392/394, 395, 392/402, 405, 406; 261/94, 99, 100, 104, 107, 139, 142, DIG. 69; 122/366

(56) References Cited

U.S. PATENT DOCUMENTS 1,944,821 A * 1/1934 Blaise ..... 392/395
3,719,795 A * 3/1973 Bolomier et al. ..... 392/395
4,110,419 A * 8/1978 Miller ..... 128/203.27
4,465,458 A * 8/1984 Nishino et al. ..... 261/107
4,748,314 A * 5/1988 Desage ..... 261/142
4,924,068 A * 5/1990 Henri ..... 392/395
5,111,529 A * 5/1992 Glucksman ..... 392/394

* cited by examiner

*Primary Examiner*—Sang Paik
(74) *Attorney, Agent, or Firm*—Charles F. Meroni, Jr.

(57) ABSTRACT

A humidifier includes a base defining an evaporation cavity, a water supply is supported on the base and has a discharge opening communicating with the evaporation cavity and is adapted to maintain a given level of water therein. A humidification unit is removably mounted on the base and includes a heating element projecting into the cavity with a wicking sleeve surrounding the element and into the cavity to wick water therefrom. Energization of the heating element causes evaporation of the water that has been wicked from the cavity. The resulting vapor is discharged through an exhaust grill above the cavity.

13 Claims, 7 Drawing Sheets

HUMIDIFIER

RELATED APPLICATION

This application is a continuation and formalization of co-pending U.S. Provisional Application Ser. No. 60/237,928, filed Oct. 3, 2000 the specification of which is hereby incorporated by reference.

BACKGROUND OF THE INVENTION

This invention relates generally to humidifiers and, more specifically, to portable humidifiers intended for domestic use.

Various types of humidifiers are used to increase the humidity in the home environment. With respect to portable humidifying appliances, they may be broken down broadly into three categories, one being the evaporating type, one being the steaming type, and the last being the misting type. Evaporating type humidifiers typically use belts or pads to increase the rate of evaporation of the water from the liquid to the vapor state. Steaming humidifiers, or vaporizers, generally are used to achieve very high humidification levels by raising the water's temperature above its boiling point. Misting humidifiers use mechanical means to atomize water into small droplets which are dispersed by a fan. The present invention is most closely related to humidifiers of the steaming and evaporating types.

Examples of various prior-art steaming humidifiers are disclosed in U.S. Pat. Nos. 5,067,169, 5,131,070, 5,133,044, and 5,143,460. All of these humidifiers are characterized by disclosing humidification means in which a heating element hangs into a water reservoir to cause boiling of the water in the reservoir. This boiling results in vaporization of the water from the reservoir, but characteristically leaves behind the minerals and impurities from the water to collect on the heating element as slag which thereby diminishes the element's performance and efficiency.

Examples of various prior art evaporative humidifiers are disclosed in U.S. Pat. Nos. 5,034,162 and 5,108,663. These humidifiers are characterized by disclosing humidification means in which an absorbant and porous pad is placed partially in a water reservoir and partially in an air stream to cause wicking of the water from the reservoir into the airstream. This results in evaporation of the water from the reservoir into the airstream, but is characteristically inefficient as the water and the porous pads are maintained at room temperature. Additionally, the evaporation of water from the pads causes a temperature drop in the exhausting humidified air which is often undesireable in the home environment.

The object of this invention, therefore, is to provide an improved portable humidifier for use in domestic applications.

SUMMARY OF THE INVENTION

The present invention is a portable humidifier including a base defining a water supply cavity; a liquid supply means supported on the base and having a discharge opening communicating with the supply cavity and adapted to maintain a given level of liquid therein; and an humidification unit removably mounted on the base and comprising an electrically energized heater within a porous fabric wicking sleeve projecting into the cavity and adapted to efficiently and rapidly induce warm evaporation of the water, and a vapor passage having a receiving end communicating with the cavity so as to receive vapor therefrom and a discharge end for discharging the vapor received from the cavity into the surrounding environment.

According to one feature of the invention, the porous fabric wicking sleeve pulls water, including its minerals and impurities, from the cavity by capillary action to the surface of the heating element, where it is rapidly evaporated leaving those impurities and minerals in the sleeve.

According to another feature, the porous fabric wicking sleeve is easily removable from the heating element. For that reason cleaning of the boiler cavity is simplified and the heating element is kept clean and operating efficiently. The sleeve can easily be removed and regularly washed to remove those impurities and minerals. This feature further also enhances the evaporation efficiency of the unit.

According to another feature, the heating element preheats the water to increase the rate of evaporation, and the heating element also increases the temperature of the exhausted airstream to overcome the temperture drop otherwise inherent in evaporative humidifiers.

According to another feature, during normal operation, the wetted wicking sleeve remains at approximately 100 C degrees, the boiling temperature of water, and the heating element's surface temperature is thereby regulated. When the supply of water is depleted or the wicking action of the sleeve is reduced, such as by deterioration or excessive residue accumulation, the heating element will realize a sudden increase in surface temperature. A temperature-limiting device in thermal communication with the heating element is thereby triggered to de-energize the heating element and safely disable the humidifier. This same temperature-limiting device also senses the rise in temperature that occurs when the humidification unit is removed from the base and the wick subsequently dries, and thereby serves and a safety shut-off for preventing use of the humidifier when it is not properly assembled.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 1:
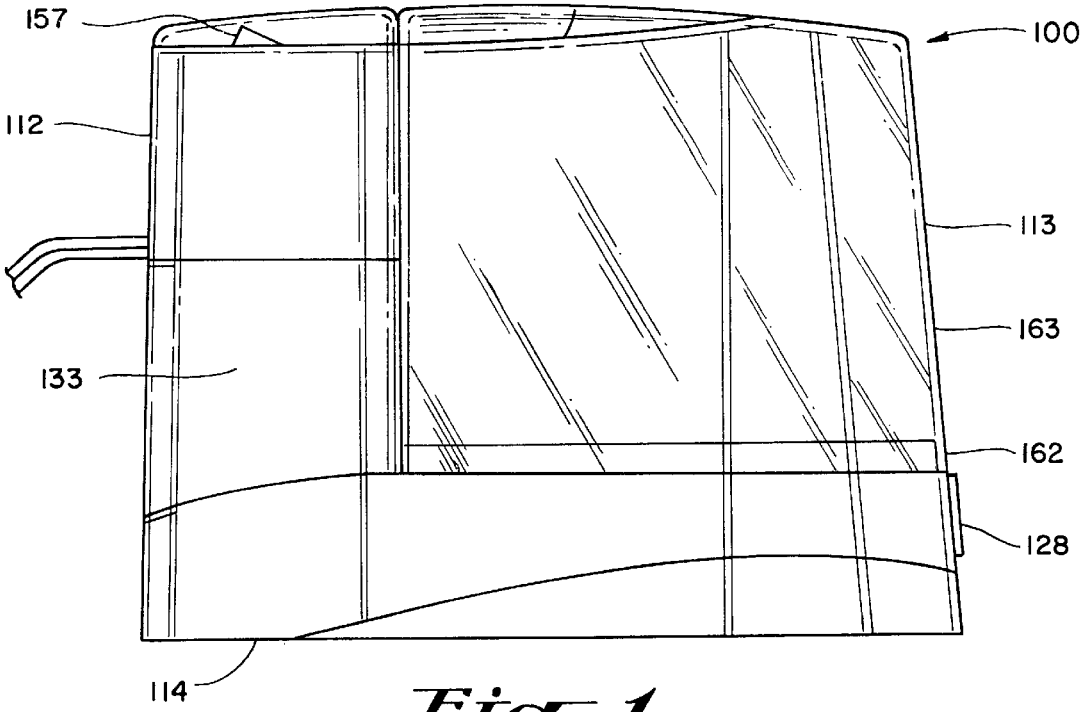
FIG. 1 is a front view of a humidifier in accordance with the preferred embodiment of the invention.
Figure 2:
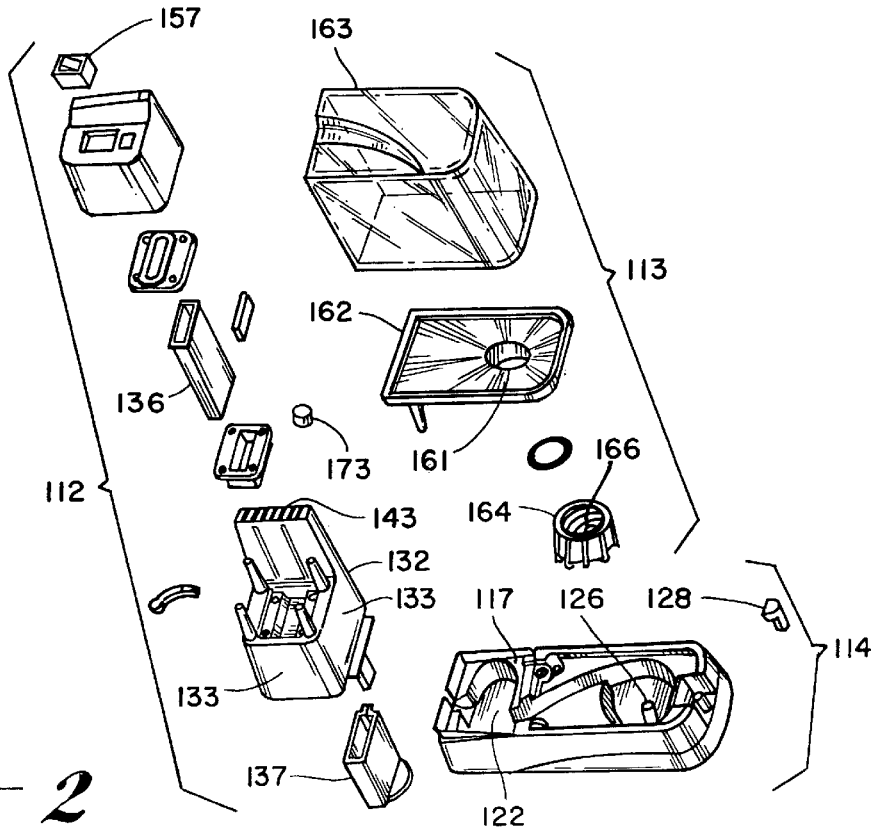
FIG. 2 is an exploded perspective view of the humidifier of FIG. 1.
Figure 3:
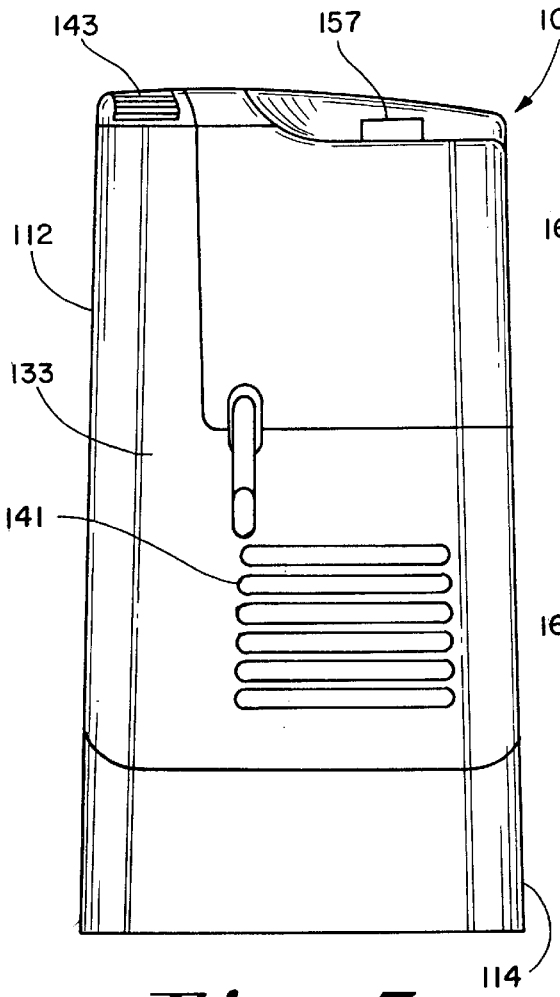
FIG. 3 is a left-end view of the humidifier of FIG. 1.
Figure 4:
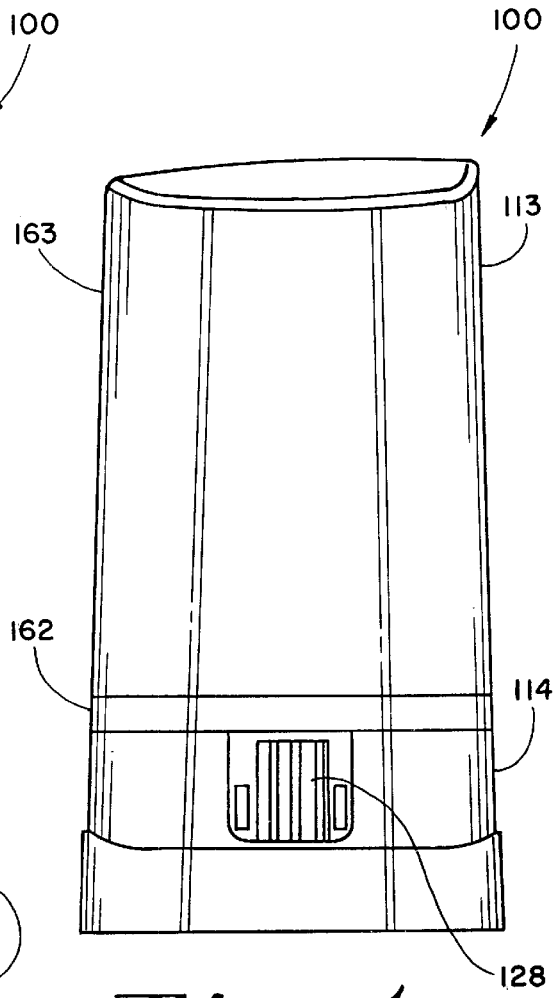
FIG. 4 is a right-end view of the humidifier of FIG. 1.
Figure 5:
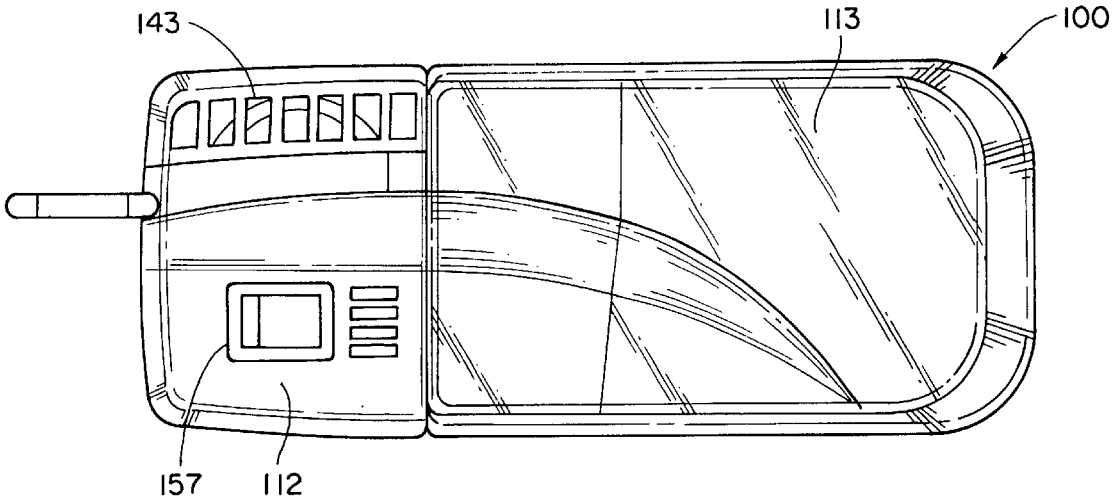
FIG. 5 is a top view of the humidifier of FIG. 1.
Figure 6:
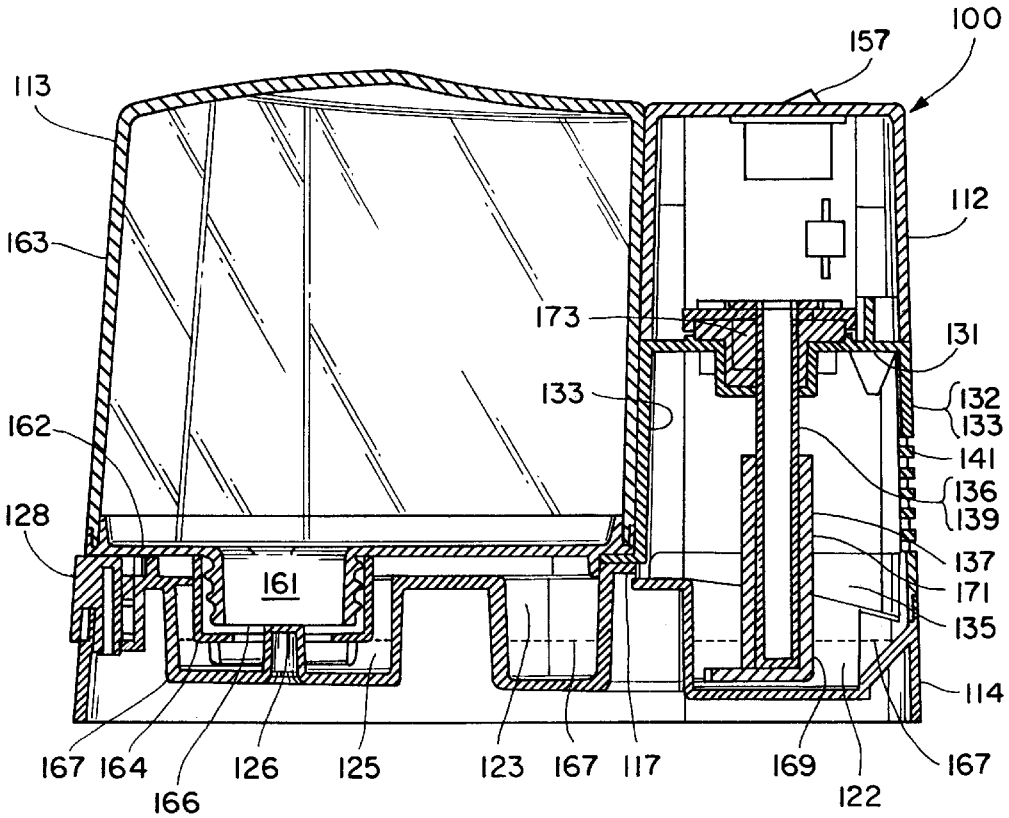
FIG. 6 is a longitudinal cross-sectional view through the humidifier of FIG. 1.
Figure 7:
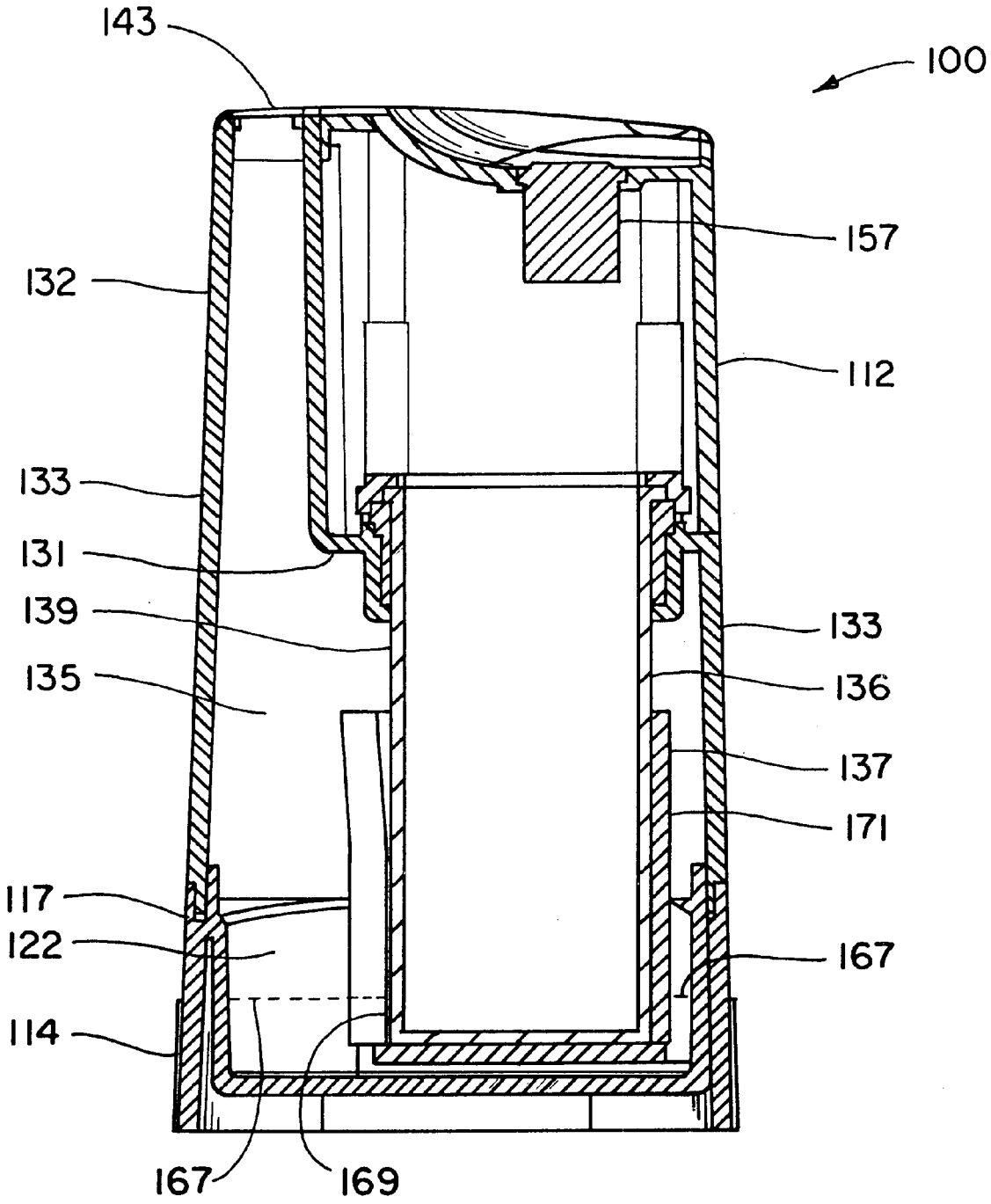
FIG. 7 is a transverse cross-sectional view through the humidifier of FIG. 1.
Figure 8:
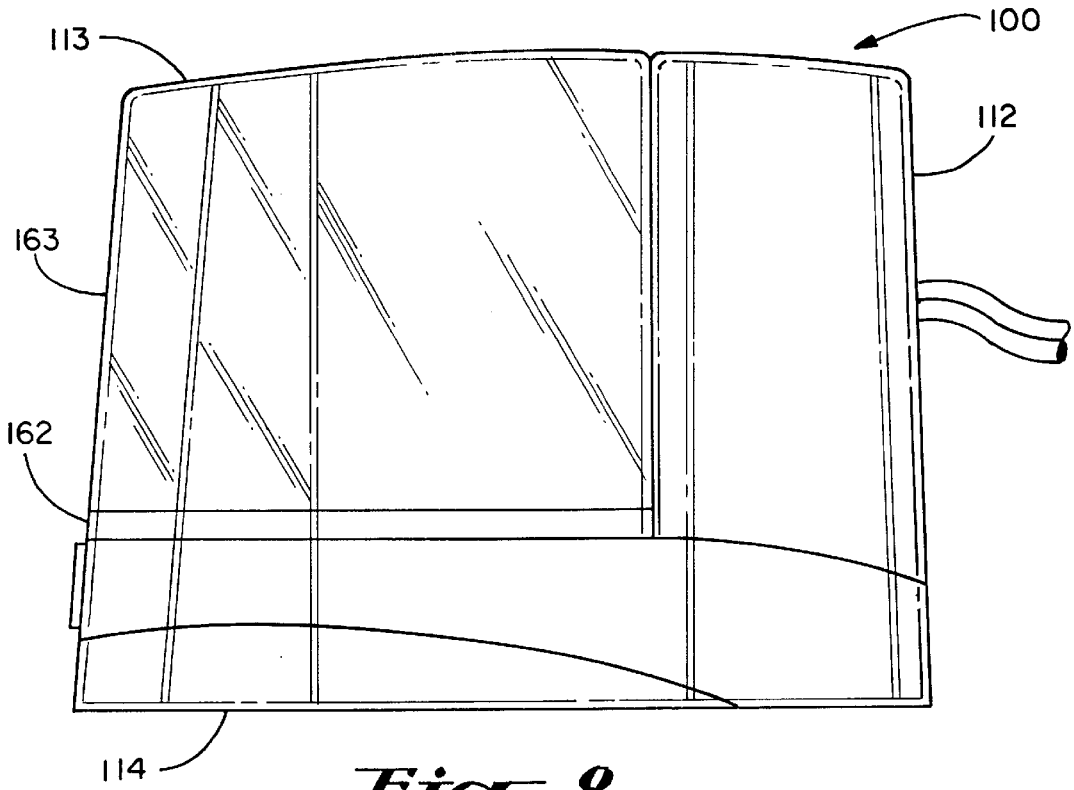
FIG. 8 is a rear view of the humidifier of FIG. 1.

A humidifier 100 according to the preferred embodiment of the invention is shown in FIGS. 1 though 10. A humidification unit 112 and a liquid supply tank 113 are each removably mounted side by side on a base 114.

Formed into the upper surface 117 of the base is a reservoir 120 that includes a evaporation cavity 122. Also included in the reservoir is a liquid supply channel 123 communicating with the evaporation cavity 122 and is an inlet cavity 125 located under the supply tank 113. A valve actuator stem 126 projects upwardly from within the inlet cavity. Pivotally mounted on the base is a latch member 128 for securing the supply tank 113 to the base.

The humidification unit 112 includes a horizontal wall 131 within an enclosure 132. The horizontal wall and side walls 133 of the enclosure cooperate with the evaporation cavity 122 of the base 114 to define an evaporation chamber 135. Extending downwardly within the chamber from the horizontal wall is a heating element 136 that projects into the evaporation cavity 122 of the base 114. A porous fibre wicking sleeve 137 surrounds the heating element and is adapted to draw water by capillary action from the evaporation cavity to the surface 139 of the heating element. The sleeve is constructed of an absorbent fabric material such as flame-retardent polyester fiber, which has the ability to wick water from the cavity rapidly, and which is not easily flammable and tolerant to high temperatures. The sleeve is removable from the heating element, which allows physical access to the heating element surface 139 to permit cleaning of the surface and of the sleeve itself.

Figure 10:
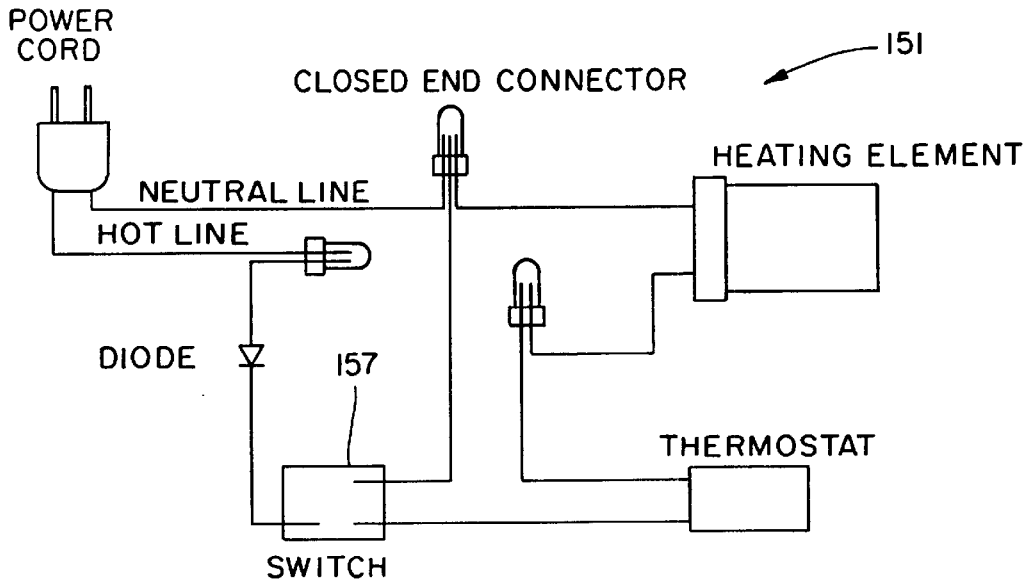
FIG. 10 is a wiring diagram of the humidifier of FIG. 1.
Figure 9:
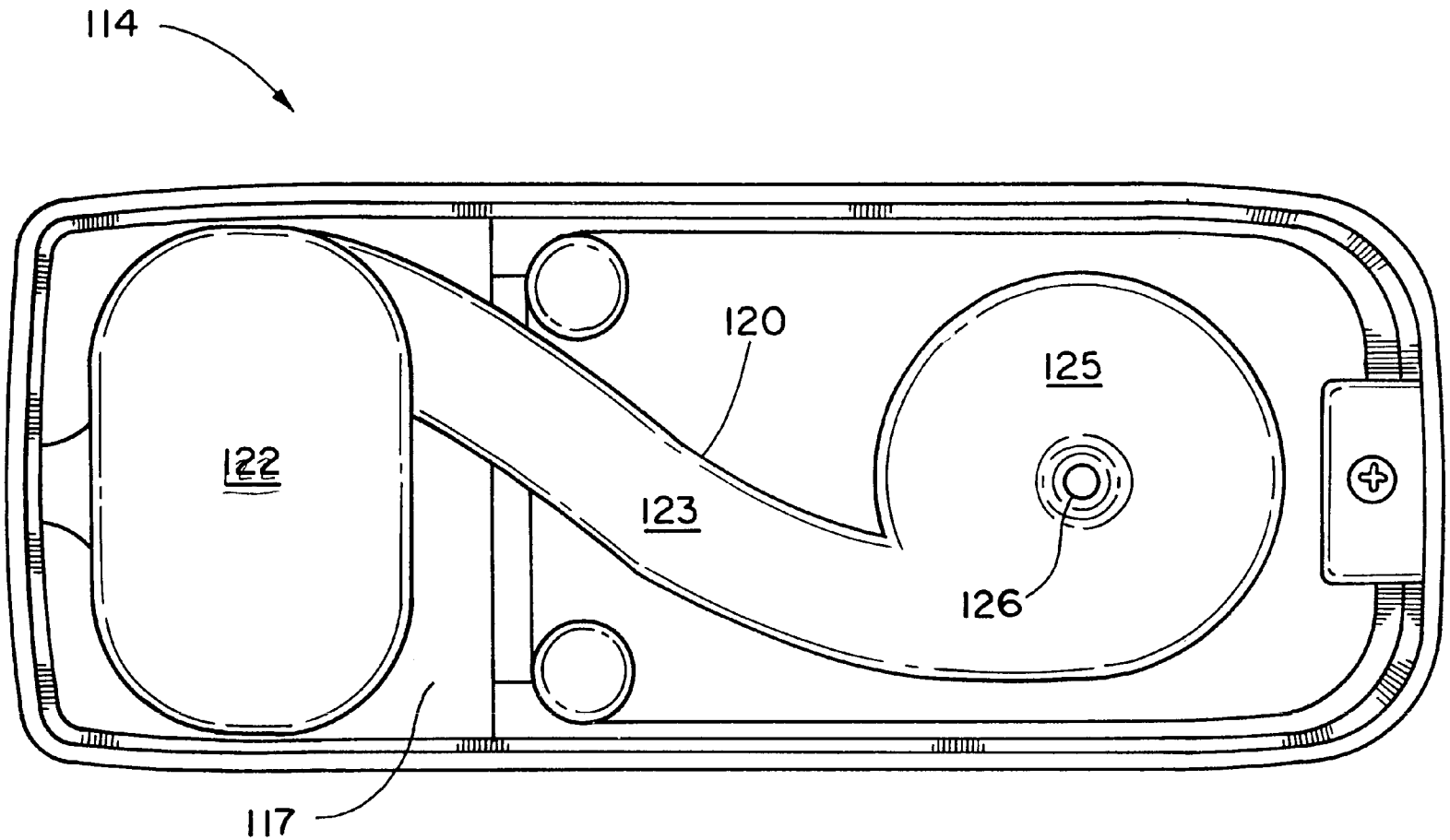
FIG. 9 is a top view of the base of the humidifier of FIG. 1.

An intake grill 141 is disposed low on one of the endure side walls 133 and an exhaust grill 143 closes the upper end of the enclosure. The grills provide vapor communication between the evaporation cavity and the surrounding environment. Retained by the enclosure is electrical control circuitry 151 shown in FIG. 10. A control switch 157 for actuating the electrical control circuit 151 is mounted on the enclosure.

The liquid supply tank 113 includes a bottom wall portion 162 and an upper portion 163 for storing a supply of water. Closing an opening 161 in the bottom wall portion of the tank is a threaded cap 164 that can be removed to fill the tank with water. The cap includes a valve assembly 166 that projects downwardly into the inlet cavity 125 of the base. The construction of the valve assembly is typical of those of the prior art. When the supply tank 113 is properly positioned on the base 114, the valve actuator stem 126 of the inlet cavity 125 opens the valve to provide liquid communication between the tank and the inlet cavity. When the tank is not properly positioned on the tank, the valve is closed to prevent inadvertent leakage of water from the tank. The valve is adapted to fill the inlet cavity, and therefore the evaporation cavity 122, with water to a predetermined water level 167 and to maintain the water at that level until the supply tank empties.

OPERATION

To prepare the humidifier 100 for use, the tank 113 is removed from the base 114 and filled with water through an opening created by removal of the cap 164. With the cap replaced and the sealed tank inverted and positioned on the base, the valve 166 is opened by the valve actuator stem 126 so that water from the tank flows through the opened valve, through the inlet cavity 125, through the supply channel 123, and into the evaporation cavity 122 to submerge the lower portion 169 of the wicking sleeve 137 up to the predetermined water level 167.

With the humidifier now turned on by activation of the control switch 157, the heating element 136 is energized and its surface temperature rises. The aforementioned wicking qualities of the sleeve cause water from the evaporation cavity to rise upwardly and wet the upper portion 171 of the sleeve that surrounds the heating element. Heat from the heating element causes rapid evaporation of the water from this wetted portion of the sleeve, and the drying sleeve thereby draws more water from the evaporation cavity to continually replenish itself.

The warm vapor evaporating from the sleeve creates an updraft which sucks dry air from the surrounding environment into the chamber through the intake grill 141. As this air is humidified and heated, it through the exhaust grill 143 and into the surrounding environment. The inherently limiting temperature of the evaporating water from the sleeve causes the surface temperature of the heating element to remain at approximately 100 C degrees during normal operation.

As water is depleted from the evaporation cavity 122 by its evaporation from the sleeve, the operating water level is lowered below the predetermined water level 167. This exposes the valve 166 of the tank 113 and allows air to enter the tank and water to thereby flow from the tank and replenish the water in the evaporation cavity. This continues until the operating level returns to the predetermined level 167 and blocks that air path into the tank to terminate the outflow of water from the tank.

Once the water in the tank 113 is depleted, the operating water level continues to fall and the wicking by the sleeve 137 is reduced and ultimately terminated. As the upper portion 171 of the sleeve dries, the surface temperature of the heating element rises above the normal operating temperature, which is sensed by temperature-sensor 173, which thereby opens to terminate energization to the heating element and operation of the humidifier. Similarly, in response to removal of the humidification unit 112 from the base 114, the sleeve rapidly becomes dry and the heating element temperature rises to open the temperature sensor and de-energize the humidifier.

Alternatively, various other low-water sensing means from the prior art may be adapted for use in the present invention.

Figure 11:
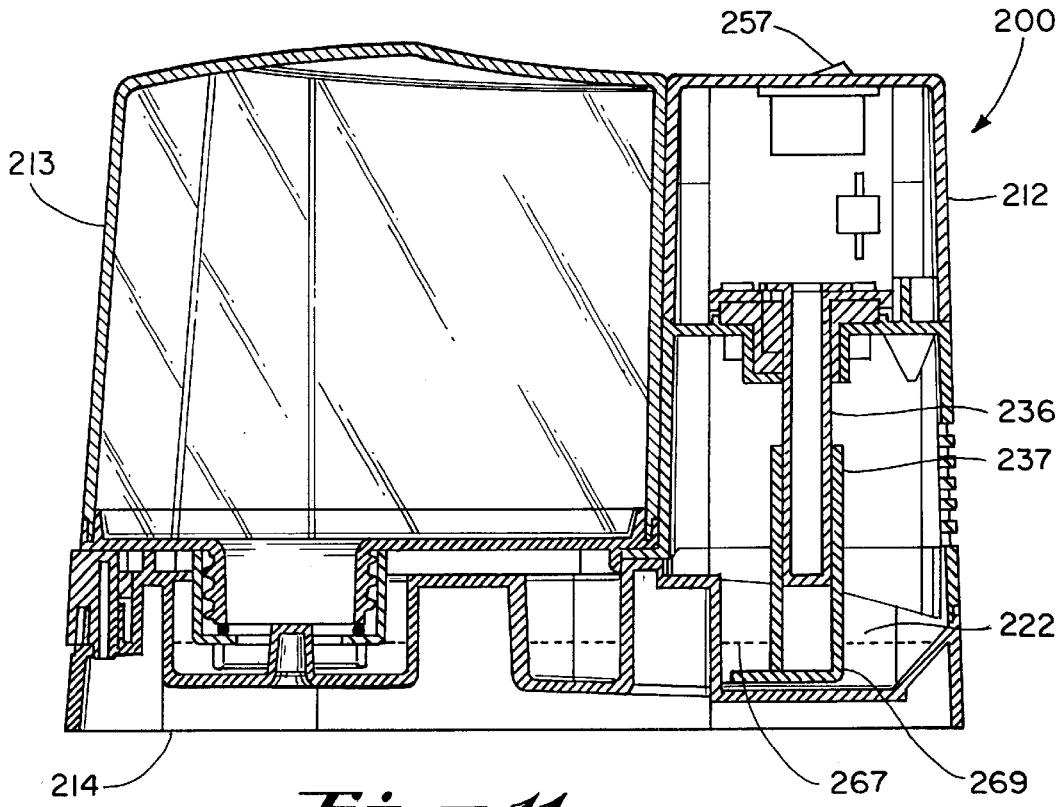
FIG. 11 is a longitudinal cross-sectional view through a humidifier according to a second embodiment of the invention.

In the above-described preferred embodiment, the heating element hangs below the water level 167 and into the water in the evaporation cavity, which pre-warms that water and is found to increase the evaporation rate from the upper portion 171 of the sleeve. But in a second embodiment of the invention 200, shown in FIG. 11, only the lower portion 269 of the sleeve 237 hangs into the water in the evaporation cavity 222, but the heating element 236 does not hang so low as the water level 267 and therfore does not contact the water.

Figure 12:
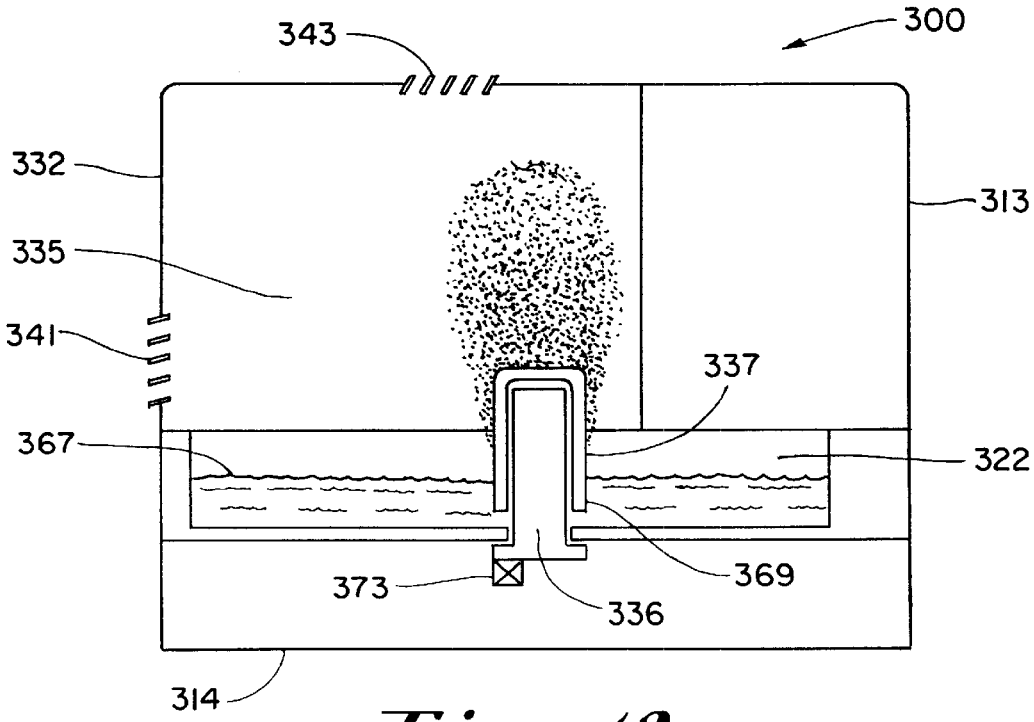
FIG. 12 is a transverse cross-sectional view through the base assembly of a humidifier according to a third embodiment of the invention.

In a third embodiment 300, shown in FIG. 12, the heating element 336 is mounted to the base 314 at the bottom of the evaporation cavity 322 and projects upwardly through the water in the evaporation cavity and into the evaporation chamber 335 above the water level 367. The sleeve 337 is fitted over the heating element such that a lower portion 369 is submerged into the water. This embodiment humidifies identically, except that in this embodiment, the enclosure 332 over the evaporation cavity is merely a cover with an intake grill 341 and an exhaust grill 343. Although a similarly affixed temperature sensor 373 is adapted to sense the heating element's temperature rise when the water supply is depleted, this embodiment lacks means to thermally sense the removal of the enclosure from the base.

Obviously, many modifications and variations of the present invention are possible in light of the above teachings. It is to be understood, therefore, that the invention can be practiced otherwise than as specifically described.

What is claimed is:

1. A humidifier comprising:

a base having a cover disposed thereon and separable therefrom, said base and cover defining an evaporation chamber; said chamber having a lower chamber portion below a predetermined level and an upper chamber portion above said predetermined level and adapted to hold a supply of water in said lower chamber portion and up to said predetermined level, said cover having an exhaust opening communicating with and disposed above said chamber;

an electrically energized heater disposed in said upper chamber portion and adapted to provide heat;

an absorbent wick having a lower wick portion disposed within the water below said predetermined level and in said lower chamber portion, and an upper wick portion in thermal communication with said heater in said upper chamber portion; and wherein said wick is adapted to draw the water from said lower chamber portion up and into thermal communication with said energized heater such that said heat from said heater induces evaporation of the water from said upper wick portion and through said exhaust opening, and wherein said wick is exposed and readily removable from said heater, when said cover is separated from said base, to allow physical access to said heater for permitting cleaning of said heater and said wick.

2. The humidifier of claim 1 wherein said base comprises said lower chamber portion and said humidifier further comprises a water supply tank disposed on said base and adapted to supply the water to said lower chamber portion and to maintain said predetermined level.

3. The humidifier of claim 2 wherein said heater is disposed in said cover and is separable from said base therewith, and wherein said heater hangs downwardly from said cover and into said evaporation chamber.

4. The humidifier of claim 3 further comprising a low-water shut-off switch for sensing the depletion or absence of water in said lower chamber portion and disabling said heater thereby.

5. The humidifier of claim 4 wherein said low-water shut-off switch comprises a thermal protector in thermal communication with said heater and adapted to sense an abnormally high heater temperature and de-energize said heater thereby.

6. The humidifier of claim 5 wherein said heater hangs into said lower chamber portion and thereby into the water therein and is adapted to preheat the water before it is drawn therefrom by said wick.

7. The humidifier of claim 5 wherein only said lower wick portion, of the group including said lower wick portion and said heater, hangs into said lower chamber portion and thereby into the water therein.

8. A humidifier comprising:

a base comprising a lower chamber portion, and said lower chamber portion adapted to hold a supply of water in and up to a predetermined level;

a cover disposed on and separable from said base, one or both of said cover and said base comprising an upper chamber portion disposed above and in communication with said lower chamber portion, and said cover comprising an exhaust opening communicating with and disposed above said upper chamber portion;

a water supply tank disposed on and separable from said base and adapted to supply the water to said lower chamber portion and to maintain said predetermined level;

an electrically energized heater disposed in said base and extending there-from into said upper chamber portion, said heater adapted to provide heat;

an absorbent wicking sleeve having a lower sleeve portion disposed within the water below said predetermined level and in said lower chamber portion, and an upper sleeve portion surrounding and in thermal communication with said heater in said upper chamber portion; and wherein said sleeve is adapted to wick the water from said lower chamber portion up and into thermal communication with said energized heater such that said heat from said heater induces evaporation of the water from said upper wick portion and through said exhaust opening, and wherein said wick is exposed and readily removable from said heater, when said cover is separated from said base, to allow physical access to said heater for permitting cleaning of said heater and said wick.

9. The humidifier of claim 8 further comprising a low-water shut-off switch for sensing the depletion or absence of water in said lower chamber portion and disabling said heater thereby.

10. The humidifier of claim 9 wherein said low-water shut-off switch comprises a thermal protector in thermal communication with said heater and adapted to sense an abnormally high heater temperature and de-energize said heater thereby.

11. A humidifier comprising:

a base comprising a lower chamber portion, and said lower chamber portion adapted to hold a supply of water in and up to a predetermined level;

a cover disposed on and separable from said base, one or both of said cover and said base comprising an upper chamber portion disposed above and in communication with said lower chamber portion, and said cover comprising an exhaust opening communicating with and disposed above said upper chamber portion;

a water supply tank disposed on and separable from said base and adapted to supply the water to said lower chamber portion and to maintain said predetermined level;

an electrically energized heater disposed in said cover and hanging there-from into said upper chamber portion, said heater adapted to provide heat;

an absorbent wicking sleeve having a lower sleeve portion disposed within the water below said predetermined level and in said lower chamber portion, and an upper sleeve portion surrounding and in thermal communication with said heater in said upper chamber portion; and wherein said sleeve is adapted to wick the water from said lower chamber portion up and into thermal communication with said energized heater such that said heat from said heater induces evaporation of the water from said upper wick portion and through said exhaust opening, and wherein said wick is exposed and readily removable from said heater, when said cover is separated from said base, to allow physical access to said heater for permitting cleaning of said heater and said wick.

12. The humidifier of claim 11 further comprising a low-water shut-off switch for sensing the depletion or absence of water in said lower chamber portion and disabling said heater thereby.

13. The humidifier of claim 12 wherein said low-water shut-off switch comprises a thermal protector in thermal communication with said heater and adapted to sense an abnormally high heater temperature and de-energize said heater thereby.

* * * * *